US006161241A

United States Patent [19]

Zysman

[11] Patent Number: 6,161,241

[45] Date of Patent: Dec. 19, 2000

[54] MATTRESS VENTS

[75] Inventor: Milton Zysman, 50 Prince Arthur Avenue, Suite 801, Toronto, Ontario, Canada, M5R 1B5

[73] Assignee: Milton Zysman, Pickering, Canada

[21] Appl. No.: 09/306,566

[22] Filed: May 6, 1999

[51] Int. Cl.[7] ..... B23P 11/00; A47C 17/00

[52] U.S. Cl. ..... 5/724; 29/243.517

[58] Field of Search ..... 5/690, 704, 724; 29/512, 243.517

[56] References Cited

U.S. PATENT DOCUMENTS

| | | | |
|---|---|---|---|
| 1,691,629 | 11/1928 | Kusterle | 5/724 |
| 2,087,969 | 7/1937 | Gookin . | |
| 3,310,871 | 3/1967 | Humiston . | |
| 3,523,313 | 8/1970 | Olsson | 5/724 |
| 3,777,966 | 12/1973 | Green | 223/104 |
| 4,479,287 | 10/1984 | Asaka | 24/141 |
| 4,833,775 | 5/1989 | Nager, Jr. | 29/747 |
| 5,426,838 | 6/1995 | Korb . | |

FOREIGN PATENT DOCUMENTS

| | | | |
|---|---|---|---|
| 700656 | 12/1953 | United Kingdom | 5/724 |

*Primary Examiner*—Michael F. Trettel
*Attorney, Agent, or Firm*—Ridout & Maybee

[57] ABSTRACT

A mattress ventilator is formed by a disk of sheet metal drawn with an array of tubular protuberances having tubular cross-sections which are very small compared with the area of the disk, open ends of the tubular protuberances being retrovertable by a die into roses for holding the disk in a mattress border. Such a ventilator can be applied to a mattress border by pressing the tubular protuberances through the border from an outer surface and retroverting the distal ends of the protuberances to form roses crimped against an inner surface of the border. The penetrations of the material of border are limited to the size of the tubular protuberances, and the perforated areas are supported and covered by the disk and act as stress reliefs for each other.

6 Claims, 1 Drawing Sheet

MATTRESS VENTS

FIELD OF THE INVENTION

It has long been common practice to provide the borders of mattresses with air vents to allow for air movement responsive to the application and relief of compressive forces to the mattress and to improve air circulation within the mattress.

The production and application of such vents has been attended by various problems. Traditional mattress vents comprised perforated or mesh grills held within eyelets crimped onto the edges of openings formed in the mattress borders. With wear and age the eyelets tend to separate from the border material, and the opening itself is a point of weakness in the border. Various proposals have been made to improve this technique, for example in U.S. Pat. No. 5,426,838 (Kolb).

Another approach to mattress ventilation has been to rely upon air flow through eyes formed in the mattress border to secure the ends of mattress handles. A disadvantage of this approach, although it provides ventilation without added cost, is that it relies on the use of a type of mattress handle which itself is less than satisfactory because it applies very high stresses to the borders and requires the formation of openings in the latter.

SUMMARY OF THE INVENTION

It is an object of the present invention to provide an improved mattress ventilator which is economical to manufacture and apply, is securely attached to the mattress border, and prejudices the integrity of the latter to a much reduced degree.

A mattress ventilator of the invention comprises a plate of sheet metal drawn with an array of tubular protuberances having tubular cross-sections which are very small compared with the area of the disk, open ends of the tubular protuberances being retrovertable by a die into roses for holding the plate in a mattress border.

Such a ventilator can be applied to a mattress border by pressing the tubular protuberances through the border from an outer surface and retroverting the distal ends of the protuberances to form roses crimped against an inner surface of the border. The penetrations of the material of border are limited to the size of the tubular protuberances, and the perforated areas are supported and covered by the disk and act as stress reliefs for each other.

An advantage of the invention is that the array of protuberances may be arranged to leave an undrawn area of the plate to receive a trademark or logo.

Further features of the invention will be apparent from the following description of a presently preferred embodiment thereof.

SHORT DESCRIPTION OF THE DRAWINGS

DESCRIPTION OF THE PREFERRED EMBODIMENT

Figure 1:
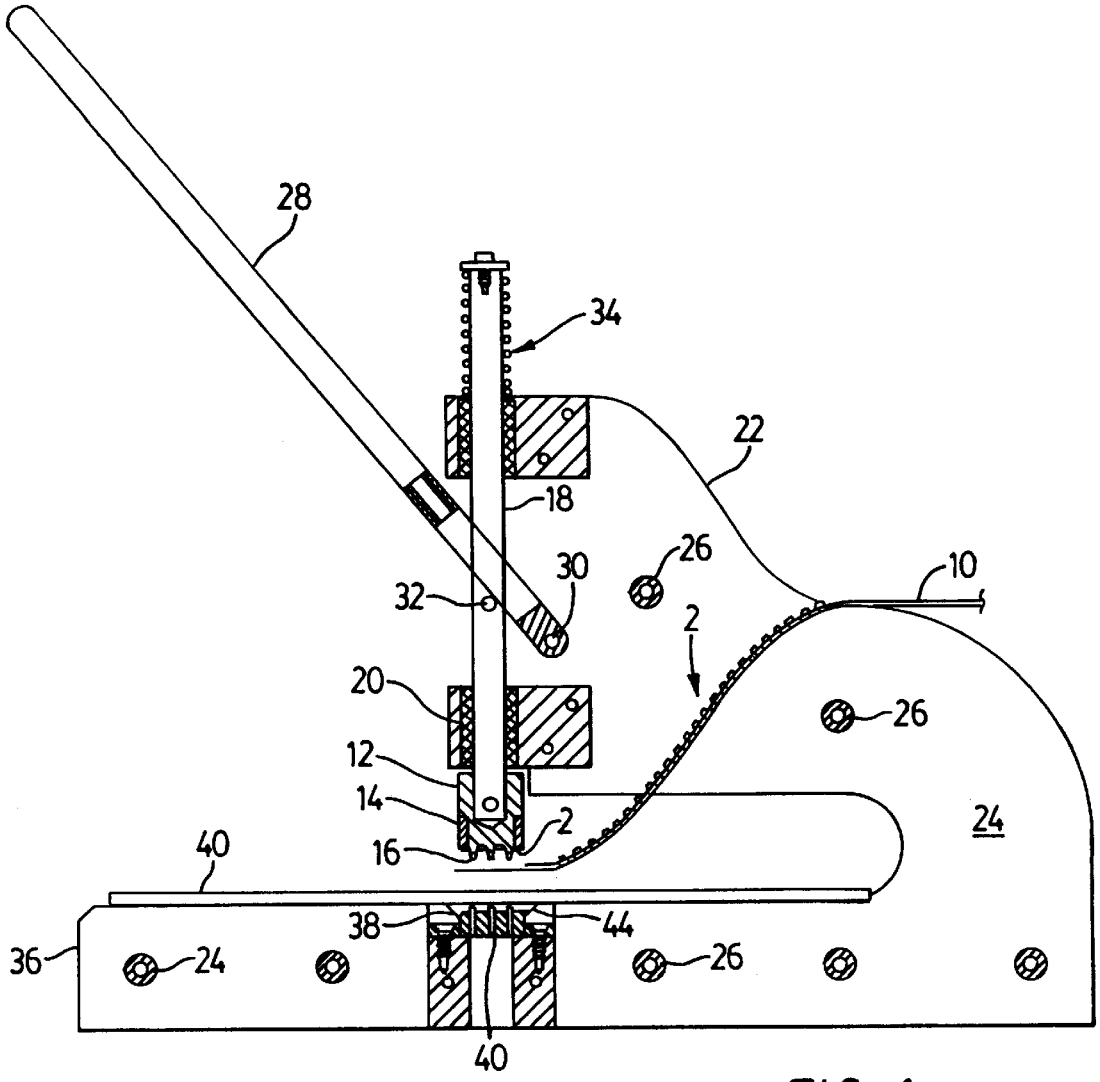
FIG. 1 shows an elevation of apparatus for applying ventilators in accordance with the invention.
Figure 2:
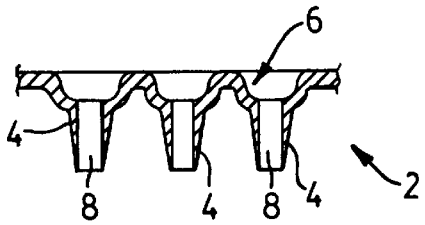
FIG. 2 shows a diametrical section through a ventilator prior to application.

The ventilators shown in FIG. 2 are stamped from steel strip, to form circular plates or disks 2 with an array of tubular protuberances 4 to one side of the strip. An exemplary form of the array is a central protuberance surrounded by a ring of six protuberances, the figure showing the central protuberances and two diametrically opposite protuberances in the ring. The plate is not necessarily circular, and the array may be arranged so as to allow space without protuberances to receive a manufacturers trademark or log. For example, the central protuberances in the above arrangement could be omitted, the space freed up being stamped with a logo. The protuberances may typically be drawn in two stages, a first stage in which a first die forms a depression 6 in the sheet, and a second stge in which a second die, which may be concentric with the first, draws down the central portion of the depression through a die to form a tube 8 of which it penetrates the distal end. Vertical ridges may be formed in a lower portion of the walls of the die to promote axial lines of weakness in a distal portion of a wall of the tube. The formed disks are then preferably nickel or brass plated and packaged in a suitable manner for delivery to the machine of FIG. 1. Various alternative materials such as aluminum could be utilized, as well as alternatives to plating, e.g. the use of brass coated stock or other finishes, but manufacture as described is presently believed most satisfactory and economical.

Referring to FIG. 1, the ventilators are fed from a vibratory feeder, a vertical tube feeder, or other suitable feeds means (not shown) to feed chute 10 which delivers ventilators in alignment to the vicinity of an upper die 12 provided with an annular magnet 14 to pick up a ventilator and locate it so that projecting pins 16 on the upper die extend through the tubular protuberances 4.

The upper die 12 is mounted on a vertical plunger 18 supported by bearings 20 in an upper jaw 22 of a body formed by spaced side plates 24 (of which only one is shown) secured together through spacers 26. A lever 28 pivoted in the body at 30 acts on a fulcrum pin 32 on the plunger 18 to propel the latter downward against a return force generated by a spring 34.

Figure 3:
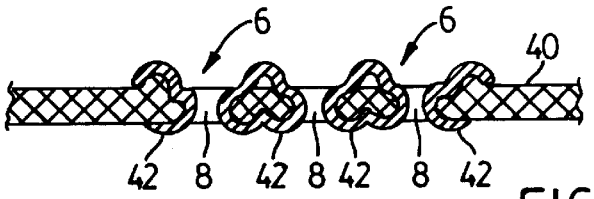
FIG. 3 shows a corresponding section through a ventilator and a mattress border after application of the ventilator.

A mattress border 40 to be processed is passed over a lower jaw 36 of the body above a lower die 38 secured in the lower jaw beneath the upper die 12. The lower die has an array of apertures 40 arranged to be entered by the pins 16 of the die 12. The apertures 40 are surrounded by annular concave surfaces 44 configured to engage distal ends of the protuberances 4 and spread them into roses 42, the outer peripheries of which are retroverted against the lower (inner in a finished mattress) surface of the mattress border 40, as seen in FIG. 3, as the lever 28 is moved to force the die 12 downwardly against the die 38 through the border 40, so that the pins 16 and protuberances 4 penetrate the border material, and the distal ends of the protuberances are retroverted into roses which secure the ventilator to the border. Upon release of the lever, the border may be advanced in a direction perpendicular to the plane of the drawing to a position for application of the next ventilator, which the magnet 14 associated with the die 12 pick up from the chute 10.

The perforations formed by the pins 16 and protuberances in the border material are quite small and do not prejudice its integrity to any significant degree while the array of protuberances means that each one acts through the disk as a strain relief for the others, with the material being substantially continuous over the remaining area of the ventilator. The protuberances 4 may typically have an internal diameter of 3 mm, and the disk about 20 mm but these dimensions may of course be varied, as may be the form of the array, and that of the plate which could be rectangular, oval or any other form although sharp corners should be avoided.

What is claimed is:

1. A mattress ventilator comprising a plate of sheet metal drawn with an array of tubular protuberances having tubular cross-sections which are very small compared with the area of the plate, open ends of the tubular protuberances being retrovertable by a die into roses for holding the plate in a mattress border.

2. A mattress ventilator according to claim 1, wherein the array comprise a central protuberance surrounded by a ring of protuberances.

3. A mattress ventilator according to claim 1, formed of steel and plated with one of brass and nickel.

4. A mattress ventilator according to claim 1, wherein the array is such as to leave an undrawn area of the plate to which a logo or trademark is applied.

5. A method of applying a ventilator to a mattress border, the ventilator comprising a plate of sheet metal drawn with an array of tubular protuberances having tubular cross-sections which are very small compared with the area of the plate, comprising pressing the tubular protuberances through the border from an outer surface thereof and retroverting the distal ends of the protuberances to form roses crimped against an inner surface of the border.

6. A method according to claim 5, conducted using a press having a first die having an array of pins corresponding to an passing through the protuberances, and a second die having a corresponding array of apertures surrounded by concave annular surfaces configured to retrovert distal ends of the protuberances on being pressed together with the first die through a mattress border.

* * * * *